US007149439B2

(12) United States Patent
Hirata et al.

(10) Patent No.: US 7,149,439 B2
(45) Date of Patent: Dec. 12, 2006

(54) METHOD AND DEVICE FOR ESTIMATING TONER CONCENTRATION AND IMAGE FORMING APPARATUS EQUIPPED WITH SUCH DEVICE

(75) Inventors: Katsuyuki Hirata, Aichi-ken (JP); Tetsuya Sakai, Aichi-ken (JP); Tatsuya Isono, Toyohashi (JP); Hironori Akashi, Okazaki (JP); Toshio Tsuboi, Okazaki (JP); Takashi Harashima, Toyokawa (JP); Masaki Tanaka, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 47 days.

(21) Appl. No.: 11/008,605

(22) Filed: Dec. 10, 2004

(65) Prior Publication Data

US 2006/0018674 A1 Jan. 26, 2006

(30) Foreign Application Priority Data

Jul. 23, 2004 (JP) ..... 2004-215848

(51) Int. Cl.
*G03G 15/08* (2006.01)

(52) U.S. Cl. ..... 399/29

(58) Field of Classification Search ..... 399/28, 399/29, 58, 60, 72, 258
See application file for complete search history.

(56) References Cited

U.S. PATENT DOCUMENTS 4,666,801 A * 5/1987 Kimura et al.
5,708,918 A 1/1998 Okuno et al.
5,724,627 A * 3/1998 Okuno et al. ..... 399/58
5,826,136 A * 10/1998 Saiko et al. ..... 399/58
5,920,748 A 7/1999 Kawai et al.
5,999,761 A * 12/1999 Binder et al. ..... 399/60
6,798,999 B1 * 9/2004 Itagaki et al.

FOREIGN PATENT DOCUMENTS

| | | |
|---|---|---|
| JP | 8-248750 | 9/1996 |
| JP | 9-106168 | 4/1997 |
| JP | 2002-162795 | 6/2002 |

* cited by examiner

*Primary Examiner*—David M. Gray
*Assistant Examiner*—Laura K. Roth
(74) *Attorney, Agent, or Firm*—Morrison & Foerster LLP

(57) ABSTRACT

A method and device for estimating toner concentration in a two-component developer consisting of toner and carrier for an electrophotographic image forming apparatus, and an image forming apparatus equipped with such device. The above method and device calculate an amount of toner charge from data detected by a transferred toner amount sensor, compensate the toner charge based on environmental humidity data and cumulative use period data of the image forming apparatus, and estimate toner concentration. The image forming apparatus equipped with the above device exerts control to predict toner consumption from the estimated toner concentration, supply toner to a developing unit according to the predicted toner consumption, and maintain the toner concentration in the developer at predetermined concentration.

8 Claims, 16 Drawing Sheets

Fig. 14

| | | CALCULATED VALUE OF TONER CONCENTRATION Tc(%) | | | | | | | | | | | | |
|---|---|---|---|---|---|---|---|---|---|---|---|---|---|---|
| | | 4 | 4.5 | 5 | 5.5 | 6 | 6.6 | 7 | 7.5 | 8 | 8.5 | 9 | 9.5 | 10 |
| PREDICTED TONER CONSUMTION CONS-page(mg) | 0 | 200 | 200 | 200 | 161 | 122 | 122 | 42 | 10 | 0 | 0 | 0 | 0 | 0 |
| | 20 | 200 | 200 | 200 | 161 | 122 | 122 | 42 | 20 | 10 | 0 | 0 | 0 | 0 |
| | 40 | 207 | 207 | 207 | 173 | 125 | 125 | 57 | 40 | 20 | 10 | 0 | 0 | 0 |
| | 60 | 214 | 214 | 214 | 180 | 140 | 140 | 74 | 50 | 30 | 10 | 0 | 0 | 0 |
| | 80 | 221 | 221 | 221 | 189 | 164 | 164 | 86 | 74 | 40 | 30 | 20 | 0 | 0 |
| | 100 | 228 | 228 | 228 | 194 | 172 | 172 | 100 | 92 | 50 | 40 | 30 | 0 | 0 |
| | 120 | 236 | 236 | 236 | 198 | 178 | 178 | 115 | 99 | 60 | 50 | 42 | 0 | 0 |
| | 140 | 243 | 243 | 243 | 204 | 184 | 184 | 129 | 105 | 70 | 62 | 42 | 0 | 0 |
| | 160 | 251 | 251 | 251 | 208 | 191 | 191 | 144 | 111 | 80 | 65 | 42 | 0 | 0 |
| | 180 | 258 | 258 | 258 | 213 | 199 | 199 | 158 | 119 | 90 | 67 | 42 | 0 | 0 |
| | 200 | 265 | 265 | 265 | 223 | 209 | 209 | 172 | 129 | 100 | 71 | 42 | 0 | 0 |
| | 220 | 272 | 272 | 272 | 239 | 222 | 222 | 186 | 142 | 110 | 75 | 42 | 0 | 0 |
| | 240 | 280 | 280 | 280 | 260 | 240 | 240 | 200 | 160 | 120 | 81 | 42 | 0 | 0 |
| | 260 | 298 | 298 | 298 | 272 | 256 | 256 | 205 | 168 | 130 | 97 | 52 | 30 | 0 |
| | 280 | 313 | 313 | 313 | 280 | 267 | 267 | 219 | 173 | 140 | 107 | 61 | 30 | 0 |
| | 300 | 320 | 320 | 320 | 291 | 274 | 274 | 219 | 177 | 150 | 115 | 71 | 40 | 0 |
| | 320 | 327 | 327 | 327 | 303 | 280 | 280 | 219 | 180 | 160 | 121 | 81 | 40 | 0 |

METHOD AND DEVICE FOR ESTIMATING TONER CONCENTRATION AND IMAGE FORMING APPARATUS EQUIPPED WITH SUCH DEVICE

This application is based on application No. 2004-215848 filed in Japan, contents of which is hereby incorporated by reference.

BACKGROUND OF THE INVENTION

1. Field of the Invention

The present invention relates to image forming technologies such as copiers, printers, and facsimiles that form color or monochrome images by using image forming methods such as electrophotography, electrostatic recording, ionography, and magnetic recording and more particularly to a method and device for estimating toner concentration from amounts of toner transferred onto a photosensitive medium and other data and an image forming apparatus equipped with such device.

2. Prior Art

Electrophotographic image forming apparatuses that develop and visualize electrostatic latent images formed on the photosensitive medium, employing a two-component developer (developing agent) consisting of carrier and toner, are known.

Since only the toner is consumed during the image forming process of the image forming apparatuses employing the two-component developer, the toner in the developer decreases as the image forming process is repeated and the toner concentration gradually decreases. For countermeasures, the image forming apparatuses employing the two-component developer are arranged to include a toner concentration detector and detect toner concentration at appropriate intervals in order to maintain the toner concentration in the developer within a predetermined range. Additional toner is soon supplied when it is detected that the toner concentration has decreased less than the predetermined range.

For methods by which the toner concentration detector may operate, the following two methods are known: projecting light onto the developer loaded in a developing unit and detecting the toner concentration, based on the intensity of reflected light (optical ATDC); and detecting the magnetic permeability of the developer loaded in the developing unit and detecting the toner concentration, based on the magnitude of the permeability (magnetic ATDC).

Because the toner concentration detector is needed per developing unit, as many toner concentration detectors as the number of developing units are required for image forming apparatuses with a plurality of developing units, especially, like color image forming apparatuses, and this is a factor in increasing the cost of manufacturing these apparatuses. To solve this problem, diverse methods have been proposed.

A fist method is to control toner supply in this way: forming toner patches for adjusting toner concentration on the photosensitive medium with the same color and at least two different developing bias voltages; detecting the toner image density of the formed toner patches by toner image density sensors; and, from the results of the detected toner image density of two toner patches, detecting that the toner image density falls more than a specified value (refer to Japanese Laid Open Patent Publication No. 162795/2002).

A second method is to control toner supply in this way: forming the toner patches for adjusting toner concentration with a starting developer having a known toner concentration; detecting the amount of toner transferred; calculating development efficiency (change in the amount of toner transferred as the developing bias changes); determining compensation data by comparing the calculated development efficiency with the standard development efficiency of the starting developer; compensating the calculated development efficiency with the compensation data; and estimating the toner concentration in the developer (refer to Japanese Laid Open Patent Publication No. 248750/1996).

A third method, which uses both optical and magnetic toner concentration detectors to detect toner concentration, is to control black toner supply in this way: equipping a cyan developing unit for color image forming with an optical toner concentration detector and a black developing unit with a magnetic toner concentration detector; and comparing the standard development efficiency of the detected cyan toner concentration and the standard development efficiency of the detected black toner concentration (refer to Japanese Laid Open Patent Publication No. 106168/1997).

The foregoing first method only determines whether toner concentration falls within its upper and lower limits and is effective for those developers that have a sufficiently broad control range (operating window) of toner concentration, but has a disadvantage that it cannot provide accurate control to keep the toner at a constant concentration for developers with a narrow control range of toner concentration.

To explain the foregoing second method, FIGS. 15 and 16 show relationships between developing bias voltages and detected amounts of toner transferred for different levels of toner concentration. FIG. 15 shows that the amount of toner transferred changes slightly as the developing bias voltage changes in the case of low toner concentration (line L), whereas the amount of toner transferred changes largely as the developing bias voltage changes in the case of high toner concentration (line H) FIG. 16 shows that the amount of toner transferred changes slightly as the developing bias voltage changes, whether the toner concentration is high or low.

Toner concentration can be estimated from the toner patches if a large change in the development efficiency (change in the amount of toner transferred as the developing bias changes) occurs in conjunction with change in the toner concentration, as shown in FIG. 15. But, the second method has a disadvantage that it is impossible to estimate toner concentration if a small or little change in the development efficiency (change in the amount of toner transferred as the developing bias changes) occurs in conjunction with change in the toner concentration, as shown in FIG. 16.

Furthermore, the foregoing third method uses two types of toner concentration detectors based on different methods of toner concentration detection and its disadvantage is that a plurality of detectors with different properties are required.

SUMMARY OF THE INVENTION

It is an primary object of this invention to provide a method and device for estimating toner concentration in a two-component developer consisting of toner and carrier, wherein the method and device are suitable for an electrophotographic image forming apparatus, and an image forming apparatus equipped with the device for estimating toner concentration.

It is another object of this invention to provide a method for estimating toner concentration in a two-component developer consisting of toner particles and carrier granules, wherein the method is suitable for an electrophotographic image forming apparatus, the method comprising calculating an amount of toner charge from amounts of toner transferred onto a photosensitive medium, compensating the toner charge, based on environmental humidity data and cumulative use period data of the image forming apparatus, and estimating the toner concentration by toner charge.

It is yet another object of this invention to provide a device for estimating toner concentration in a two-component developer consisting of toner and carrier, wherein the device is suitable for use in an electrophotographic image forming apparatus, the device comprising a transferred toner amount sensor which detects amounts of toner transferred onto the photosensitive medium, an environmental humidity sensor which detects relative humidity in environment, and counting instrumentation which keeps counting a cumulative use period of the image forming apparatus. The device calculates an amount of toner charge from values detected by the transferred toner amount sensor, compensates the toner charge based on environmental humidity data detected by the environmental humidity sensor and cumulative use period data of the image forming apparatus counted by the counting instrumentation, and estimates the toner concentration.

It is further object of this invention to provide an image forming apparatus that exerts control to predict toner consumption, based on the toner concentration estimated by the above method and device for estimating toner concentration, supply toner to a developing unit according to the predicted toner consumption, and maintain the toner concentration in the developer in the developing unit at predetermined concentration.

The above objects and other objects, features, and advantages of this invention will become apparent from the following detailed description of the invention with reference to the accompanying drawings.

BRIEF DESCRIPTION OF THE DRAWINGS

FIG. 14 is a numerical table that is used for obtaining an amount of toner supply from calculated toner concentration Tc and predicted toner consumption;

DETAILED DESCRIPTION OF THE PREFERRED EMBODIMENTS

Figure 1:
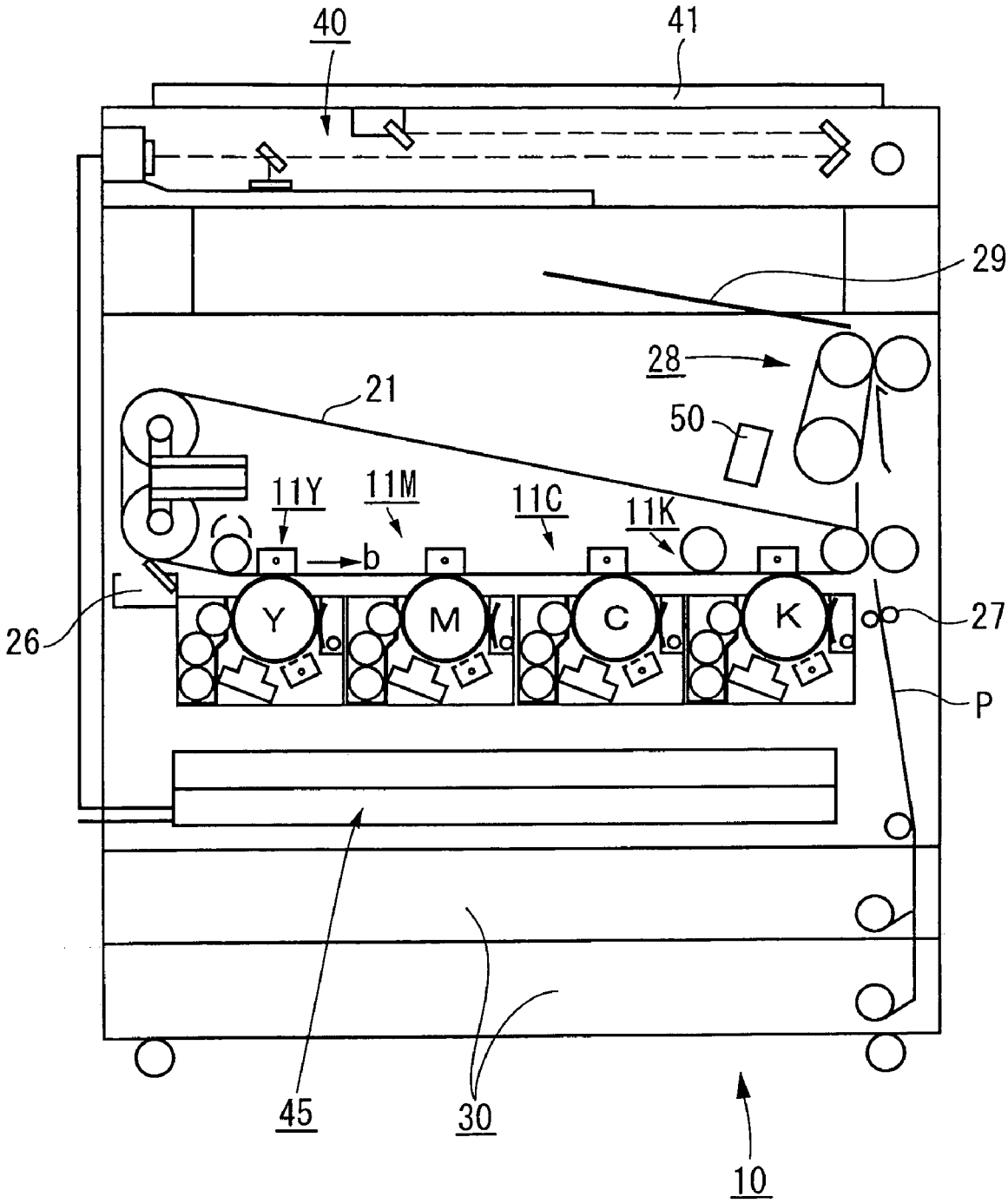
FIG. 1 is a diagram showing an image forming apparatus configuration according to an embodiment of the present invention.
Figure 2:
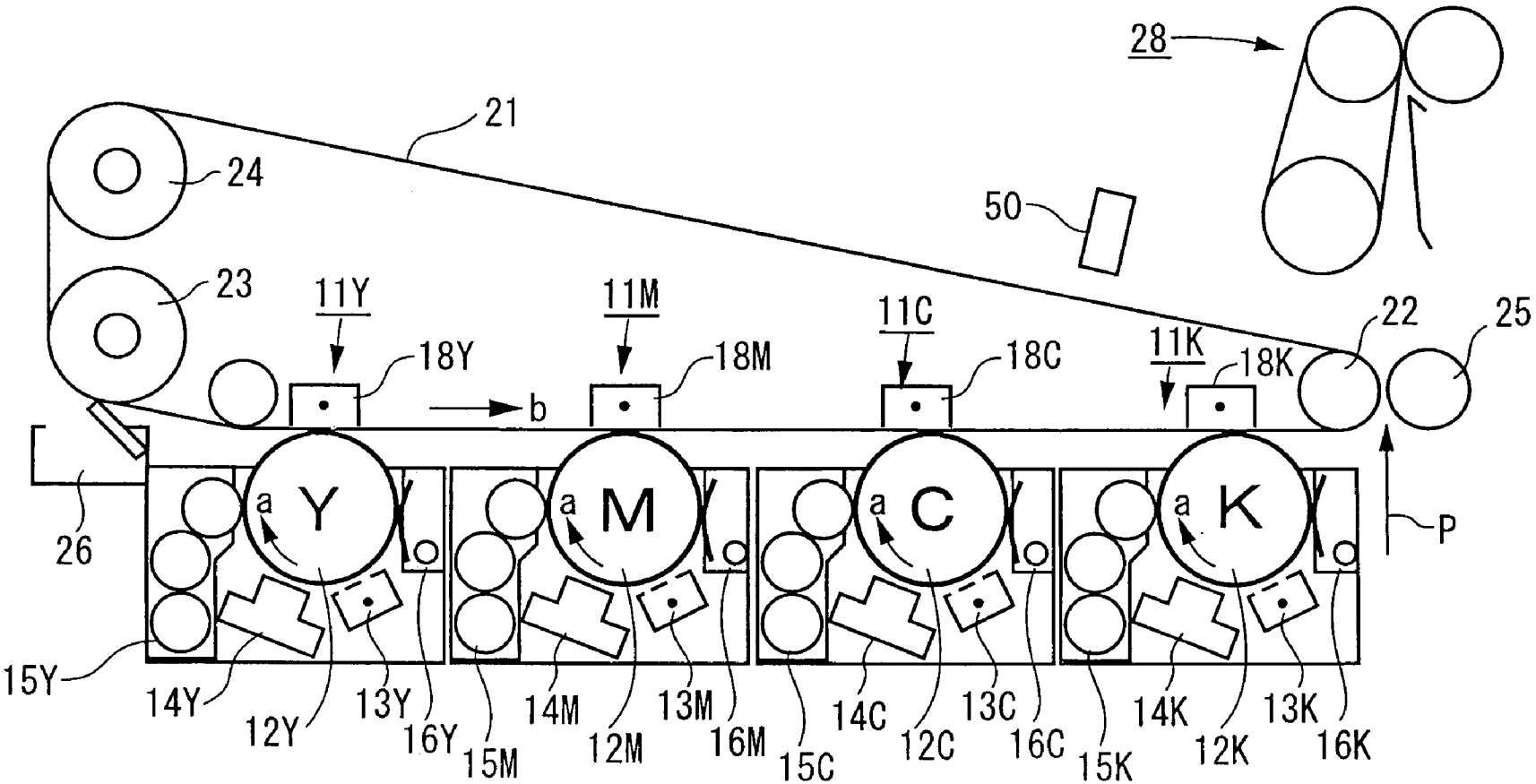
FIG. 2 is an enlarged view of image forming units of the image forming apparatus shown in FIG. 1.

An embodiment of this invention will be described hereinafter. FIG. 1 shows the configuration of a tandem, full-color image forming apparatus as an embodiment suitable for implementing this invention. FIG. 2 is an enlarged view of image forming units of the apparatus.

Referring to FIGS. 1 and 2, the configuration of the image forming apparatus 10 in outline is explained. On the top surface of the image forming apparatus 10, optical scanning unit 40 is disposed under a platen glass 41. A document sheet placed on the platen glass 41 is read by the optical scanning unit 40 and image signals are output and subjected to predetermined signal processing in an image processing unit 45. The thus processed signals are output to exposure units 14Y, 14M, 14C, 14K of image forming units 11Y, 11M, 11C, 11K which will be described later.

The image forming units 11Y, 11M, 11C, 11K for four colors, yellow (Y), magenta (M), cyan (C), and black (K) are arranged serially along an intermediate transfer belt 21. In the image forming units 11Y to 11K, photosensitive mediums 12Y, 12M, 12C, 12K are respectively installed and charging units 13Y, 13M, 13C, 13K, the exposure units 14Y, 14M, 14C, 14K, developing units 15Y, 15M, 15C, 14K, and first cleaning units 16Y, 16M, 16C, 16K are respectively arranged around the photosensitive mediums 12Y, 12M, 12C, 12K. The photosensitive mediums 12Y to 12K are arranged to rotate at a constant speed in the direction of arrow a.

In the positions opposite to the photosensitive mediums 12Y, 12M, 12C, 12K across the intermediate transfer belt 21, first transfer units 18Y, 18M, 18C, 18K are disposed. The intermediate transfer belt 21 runs across a second transfer roller 22, a driving roller 23, and a driven roller 24 and is arranged to move at a constant speed in the direction of arrow b by the turning of the driving roller that is driven by a driving unit which is not shown.

Furthermore, in the position opposite to the second transfer roller 22, a press roller 25 is located across the intermediate transfer belt 21 and recording paper P is fed from a paper feeder 30 to go through a nip formed between the intermediate transfer belt 21 and the press roller 25. Downward of the nip in the forward direction of feeding of the recording paper P, a fixing unit 28 is located. Downward of the fixing unit 28, an ejected paper tray 29 is located.

In FIGS. 1 and 2, reference numeral 50 denotes an AIDC sensor which detects the amounts of toner of each color transferred onto toner patches on the intermediate transfer belt 21 and print shifts per color, which will be described later.

The operation of the image forming apparatus is briefly explained. First, the photosensitive mediums 12Y, 12M, 12C, 12K start to rotate and the intermediate transfer belt 21 starts to move. The charging units 13Y, 13M, 13C, 13K evenly charge the surfaces of the photosensitive mediums 12Y, 12M, 12C, 12K. Recording paper P is fed from the paper feeder 30 and stops once, nipped between timing rollers 27.

After an image on a document page is read by the optical scanning unit 40, its output signals undergo predetermined signal processing in the image processing unit 45 and image signals in which color has been separated into three primary colors of read (R) green (G), and blue (B) are output.

The image signals having the values of the three primary colors obtained by color separation from the image of the scanned document or the image signals having the values of the three primary colors output from a personal computer or the like which is not shown are sequentially output to the image forming units 11Y, 11M, 11C, 11K for yellow (Y), magenta (M), cyan (C), and black (K), according to the above values.

First, by the image signals output to the image forming unit 11Y, the exposure unit 14Y is activated to form a latent image on the photosensitive medium 12Y, the latent image is developed by the developing unit 15Y, and a yellow toner image is formed. The yellow toner image on the photosensitive medium 12Y is transferred onto the intermediate transfer belt 21 through the action of the first transfer unit 18Y.

In time when the yellow toner image transferred onto the intermediate transfer belt 21 comes directly under the first transfer unit 18M, a latent image is formed on the photosensitive medium 12M in the image forming unit 11M and a magenta toner image is formed by the developing unit 15M. The magenta toner image on the photosensitive medium 12M is transferred onto the intermediate transfer belt 21 through the action of the first transfer unit 18M so that this image is superimposed over the yellow toner image.

In the same way as above, a cyan toner image formed on the photosensitive medium 12C in the image forming unit 11C is transferred onto the intermediate transfer belt 21 so that this image is superimposed over the yellow and magenta toner images which have been transferred and superimposed. Furthermore, a black toner image formed on the photosensitive medium 12K in the image forming unit 11K is transferred onto the intermediate transfer belt 21 so that this image is superimposed over the yellow, magenta, and cyan toner images which have been transferred and superimposed. As a result, a full-color toner image consisting of the four color toner images of yellow, magenta, cyan, and black super imposed with one another is formed on the intermediate transfer belt 21.

In time when the full-color toner image formed on the intermediate transfer belt 21 comes at the second transfer roller 22, the timing rollers 27 start to rotate and carry the recording paper to go through the nip formed between intermediate transfer belt 21 and the press roller 25. Through the action of the second transfer roller 22, the full-color toner image is transferred onto the recording paper P, the toner is fixed in the fixing unit 28, and the paper is ejected on the ejected paper tray 29.

When transferring the four color toner images formed on the surfaces of the photosensitive mediums 12Y, 12M, 12C, 12K onto the intermediate transfer belt 21 finishes, remaining waste toner is cleaned from the surfaces of the photosensitive mediums 12Y, 12M, 12C, 12K by the first cleaning units 16Y to 16K.

When transferring the full-color toner image formed on the intermediate transfer belt 21 onto the recording paper P finishes, remaining waste toner is cleaned from the surface of the intermediate transfer belt 21 by a second cleaning unit 26.

While the configuration and operation of the full-color image forming apparatus has been described in brief above, the apparatus carries out image density control to generate high-quality images. The image density varies by factors such as photosensitive medium charging potential, developing bias voltage, and exposure quantity. In the image forming apparatus employing a two-component developer, only the toner is consumed for image forming, but the carrier is not consumed. Therefore, the ratio of the toner in the developer gradually decreases and the image density decreases. The image density control applied herein refers to the control to maintain the image density within a given range by supplying additional toner to the developing units when the toner concentration has decreased less than the lower limit.

Figure 3:
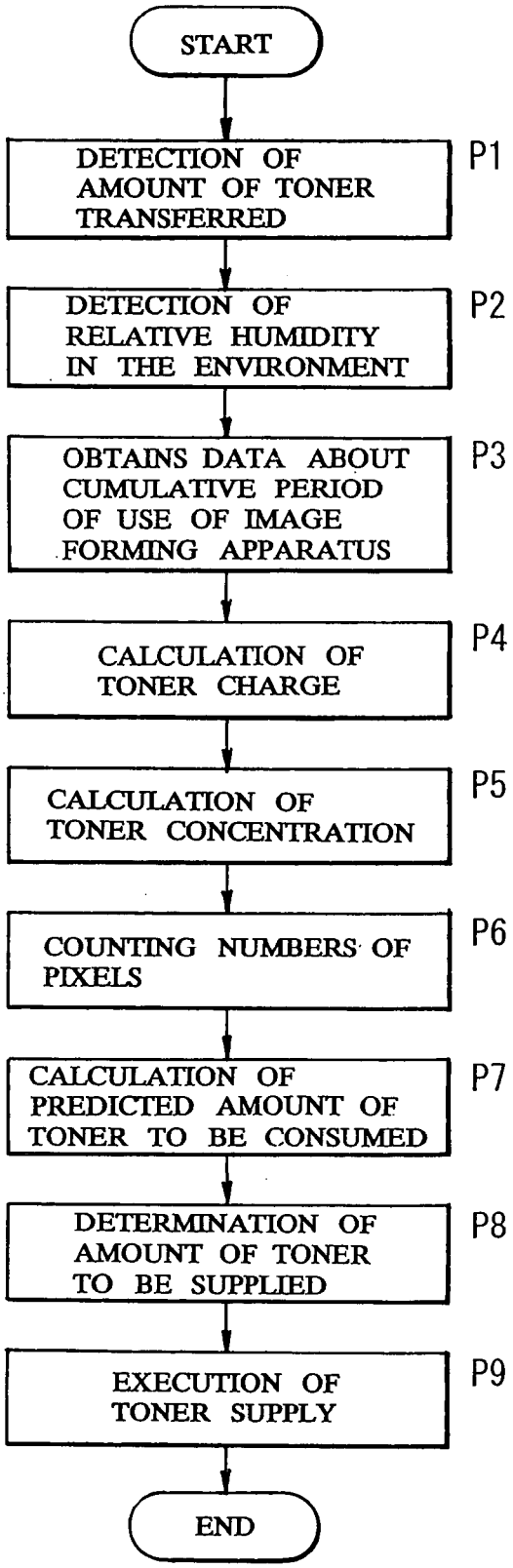
FIG. 3 is a flowchart describing an image density control process in outline.

The process of image density control consists of (1) calculating the amount of toner charge, (2) calculating toner concentration, (3) predicting the amount of toner to be consumed, and (4) supplying toner, which are carried out in order of mention. FIG. 3 is a flowchart describing this image density control process in outline, which is performed by software in the CPU of the image forming apparatus control unit which is not shown. The control process in outline will be explained below.

The above step of predicting the amount of toner to be consumed is not mandatory for toner supply. The process may be modified such that, after toner concentration calculation, if the toner concentration is less than the given range, toner supply is performed.

While the image density control process is described on the assumption that it is performed by the software in the CPU of the control unit, it may also be possible to embody this process by hardware provided with the functions that are performed by the software and it goes without saying that such embodiment is included in the present invention.

In a preparatory stage, first, test toner patches are formed on the photosensitive medium to obtain image density control data, which will be detailed later.

After the preparation finishes, the amounts of toner transferred onto the toner patches are detected by the AIDC sensor to obtain image density control data (step P1). Next, relative humidity in the operating environment of the image forming apparatus, which affects the amount of toner charge, is detected by an environmental sensor (step P2). Data about a cumulative period of use of the image forming apparatus, which affects the amount of toner charge, is obtained (step P3).

The amount of toner charge is calculated by assigning the amounts of toner transferred detected by the AIDC sensor, the relative humidity detected by the environmental sensor, and the cumulative period of use to a predetermined arithmetic expression (step P4) and toner concentration is calculated (step P5).

Furthermore, the number of pixels required for calculating the predicted amount of toner to be consumed is counted, based on a calculation method which will be described later (step P6) and the predicted amount of toner to be consumed is calculated (step P7). Based on the predicted amount of toner to be consumed, the amount of toner to be supplied is determined (step P8) and toner supply is performed by activating a toner supply unit (step P9).

A detail of the image density control process will be described.

[(1) Calculating the Amount of Toner Charge Q]

First, the conditions for image forming such as the system speed, exposure quantity, developing bias voltage, and charging voltage of the full-color image forming apparatus are set at optimum values, and toner patches are generated on the intermediate transfer belt 21.

The toner patches applied herein refer to toner patterns that are formed on the intermediate transfer belt 21 to detect the amounts of toner transferred. The toner patches for detecting the amounts of toner transferred are generated by bringing the image forming units 11Y to 11 K in operation and transferring yellow, magenta, and cyan toner patches formed on the photosensitive mediums 12Y to 12K onto the intermediate transfer belt 21, while changing the developing bias voltage.

Figure 4:
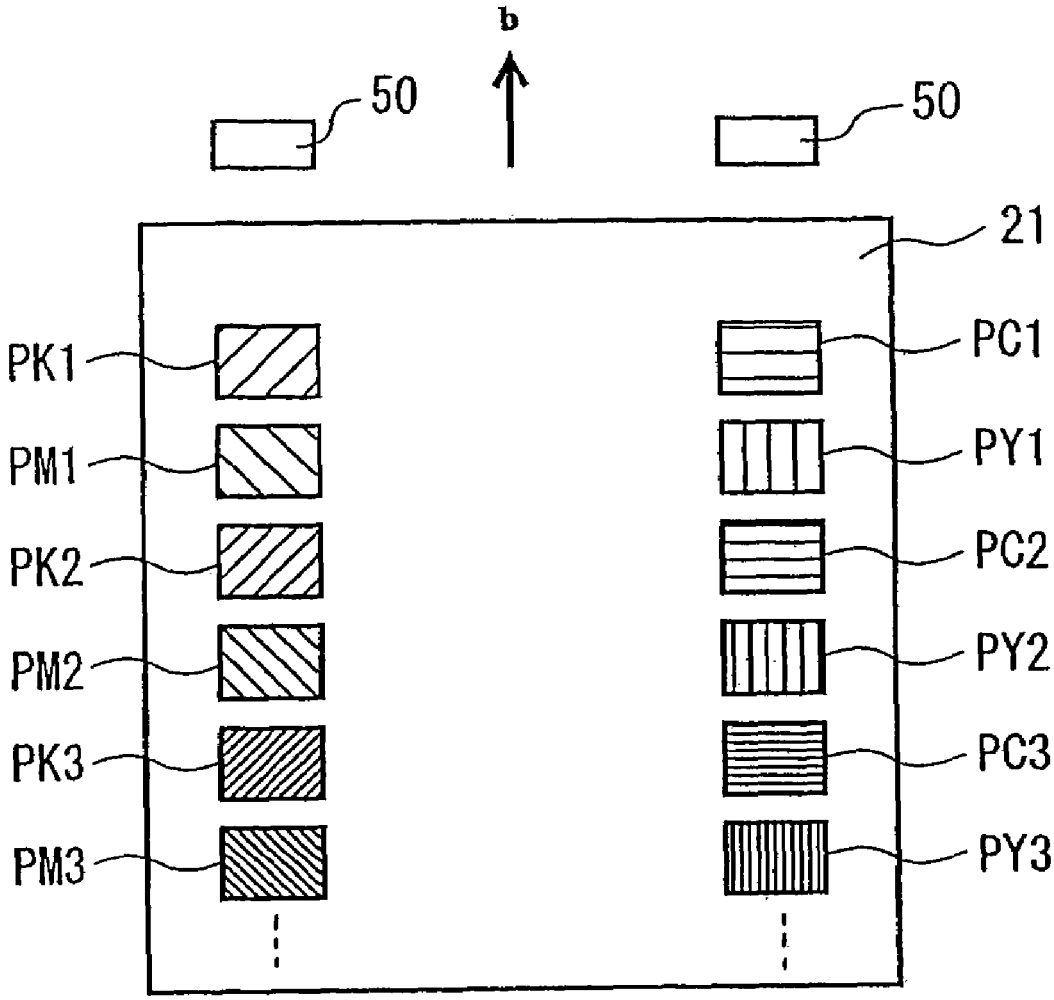
FIG. 4 is diagram illustrating toner patch examples.

FIG. 4 is a diagram illustrating toner patch examples generated on the intermediate transfer belt 21. For each of yellow, magenta, and cyan, a plurality of toner patches are generated on the intermediate transfer belt 21 with different developing bias voltages applied thereto, that is, the amount of toner transferred (image density) differs per patch, such as PC1, PK1, PY1, PM1, PC2, PK2, PY2, PM2, PC3, PK3, PY3, PM3, . . . PCn, PKn, PYn, PMn.

Next, the amounts of toner transferred onto the above toner patches PCn, PKn, PYn, PMn on the intermediate transfer belt 21 that moves in the arrow direction of b are detected sequentially by the AIDC sensor 50. The amount of toner charge Q is calculated, using the following equation (1).

Q is calculated, using the following equation (1).

$$Q = \frac{p \times \beta \times \Delta v \times \alpha}{(M/T) \times \{q \times \beta \times 1/Cm + (M/T)\}} \quad (1)$$

where, Q: Amount of toner charge p: Coefficient q: Coefficient

β: Toner layer ratio to full formation

Δv: Developing bias voltage change in steps

α: Potential ratio to full potential

M: Amount of toner transferred

T: Transfer efficiency

Cm: Electrostatic capacity of photosensitive medium

The parameters in the above equation (1):

(a) Amount of Toner Transferred M

As described above, when each of the plurality of toner patches with different bias voltages generated by the image forming units moves under the AIDC sensor, the amount of toner transferred for a particular developing bias voltage is detected. Detecting the amount of toner transferred by the AIDC sensor is performed by projecting light to the toner patch under the sensor and detecting reflected light with a photodiode. The output of the photodiode is converted to the amount of toner transferred that is determined as the detected amount of toner transferred. The quantity of the light reflected from the toner patch varies, depending on how much toner has been transferred onto the patch, in other words, how much toner covers the surface of the toner patch. For transferred toner detection, in addition to the above method that uses light projection and its reflected light, a sensor using ultrasonic waves may be applicable.

Figure 5:
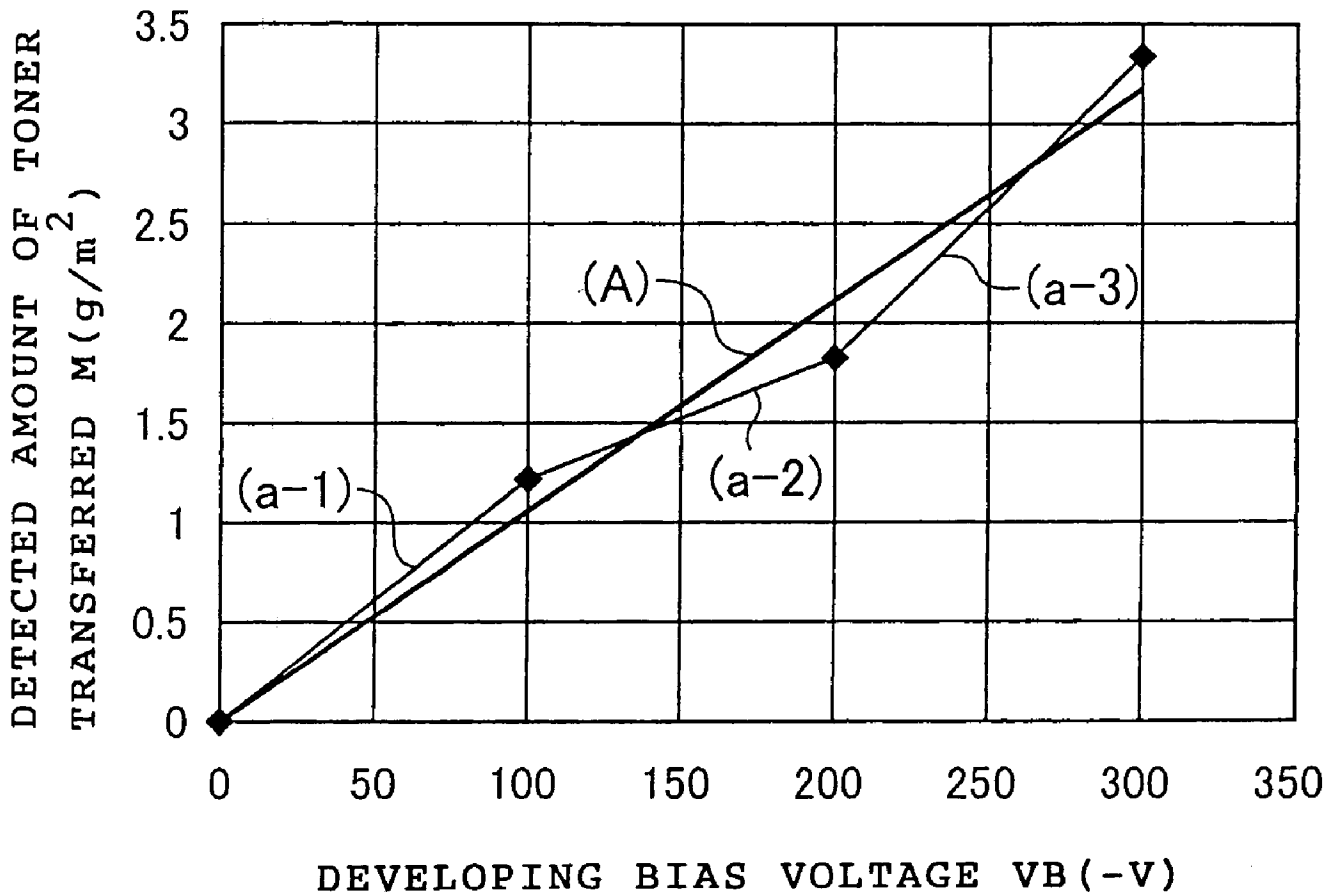
FIG. 5 is a diagram showing detected amounts of toner transferred in relation to developing bias voltages as an example of results of transferred toner detection.

FIG. 5 is a diagram showing detected amounts of toner transferred in relation to developing bias voltages as an example of results of transferred toner detection. In a developing bias voltage VB (−V) range of 0 to 100, the detected amounts of toner transferred M (g/m$^2$) show a change as a line segment (a-1). In a developing bias voltage VB range of 100 to 200, the detected amounts of toner transferred M shows a change as a line segment (a-2). In a developing bias VB range of 200 to 300, the detected amounts of toner transferred M shows a change as a line segment (a-3).

Therefore, an average of the detected amounts of toner transferred in relation to developing bias voltages shows a change as a line (A) with a gradient of 0.0105. Hence, the transferred toner amount ΔM per developing bias voltage Δv in a given unit step can be expressed as ΔM=0.0105 (g/m$^2$).

Hence, the amount of toner transferred M at a developing bias voltage VB will be expressed as follows:

$$M = 0.0105 \times VB (\mathrm{g/m^2})$$

(b) Toner Layer Ratio to Full Formation β

Toner layer ratio to full formation β indicates the thickness of a toner pattern formed as a percentage relative to the toner layer thickness of 1 (100%) for which completely saturated development is performed.

Figure 6:
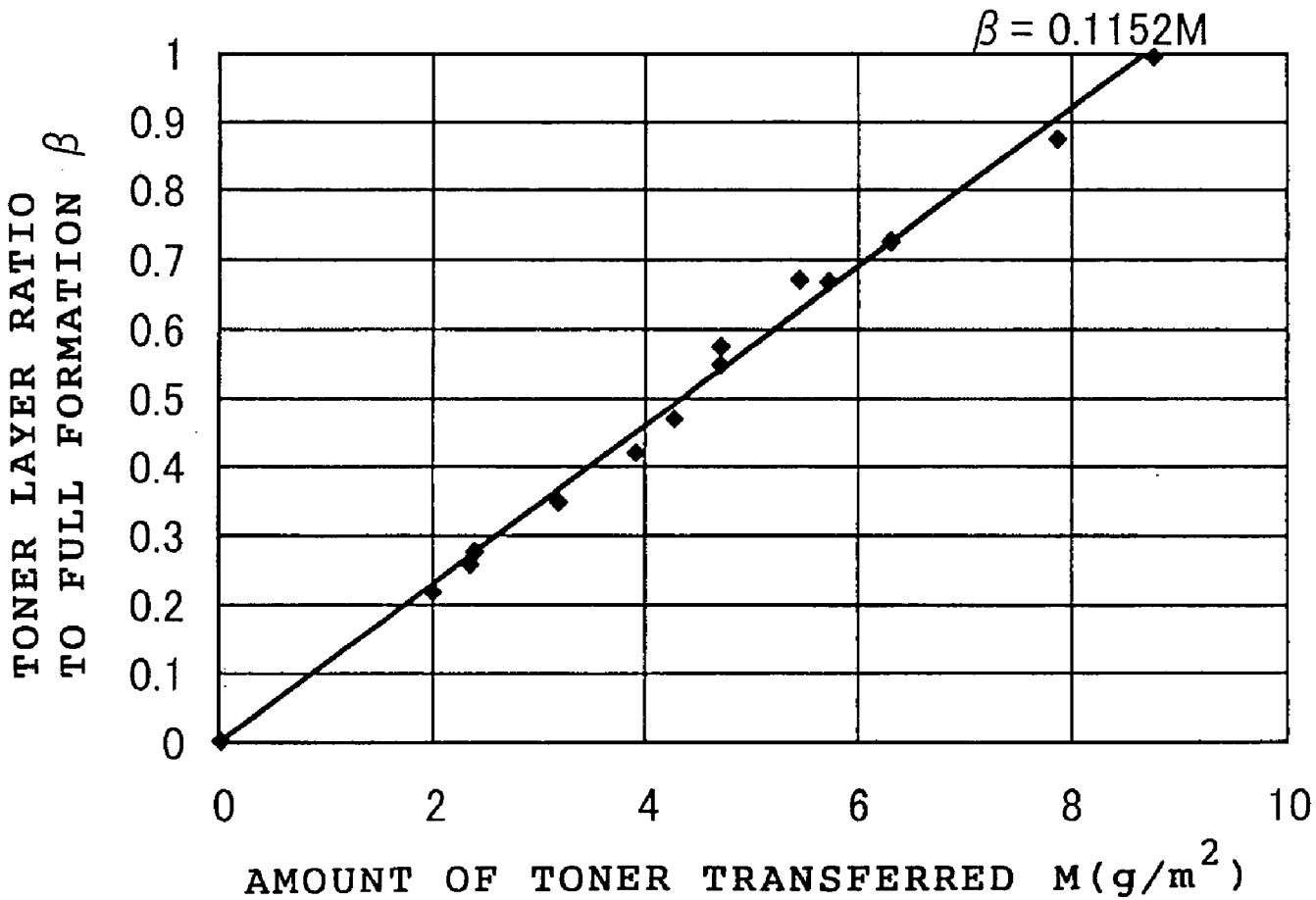
FIG. 6 is a diagram showing a correlation between toner layer ratio to full formation β and amount of toner transferred.

FIG. 6 is a diagram showing a relationship between amount of toner transferred M (g/m$^2$) and toner layer ratio to full formation β. In the case of a development system where this correlation is true, toner layer ratio to full formation β can be obtained from the detected amount of the toner transferred.

In particular, if the transferred toner amount ΔM per developing bias voltage Δv in a given unit step is relatively large, calculated from the amounts of toner transferred M detected by the AIDC sensor, it is preferable to set the toner layer ratio to full formation β larger, based on the correction shown in FIG. 6. If the transferred toner amount ΔM per developing bias voltage Δv in a given unit step is relatively small, it is preferable to change the setting and set the toner layer ratio to full formation β smaller.

The toner layer ratio to full formation β may be obtained from an arithmetic expression representing the above correction shown in FIG. 6 or a table containing the data for the correction show in FIG. 6.

(c) Potential Ratio to Full Potential α

Figure 7:
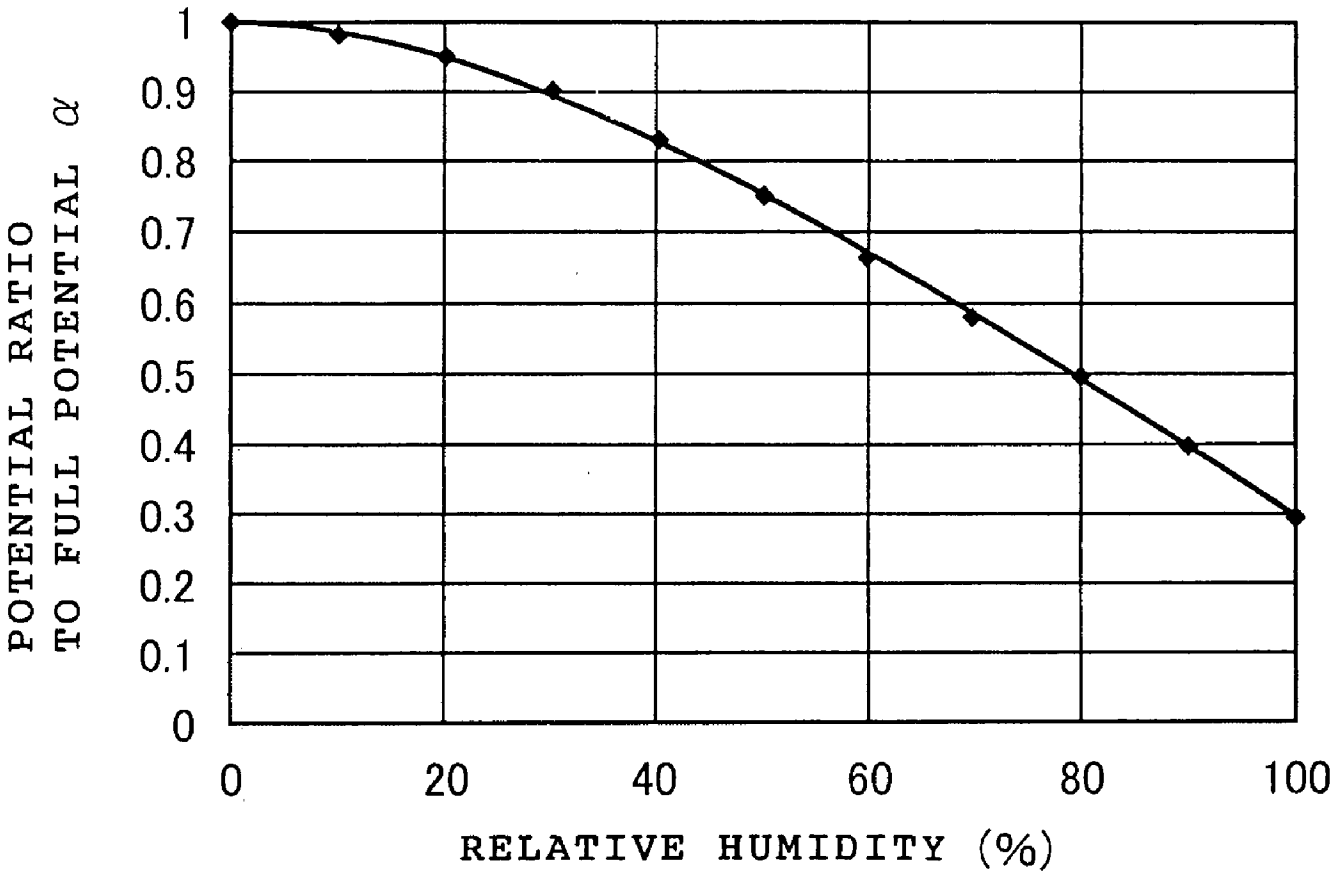
FIG. 7 is a diagram showing a relationship between relative humidity and potential ratio to full potential α.

Potential ratio to full potential a indicates the ratio of the potential of a toner layer after development to the developing bias voltage Δv in a given unit step, which is defined as follows:

Potential ratio to full potential α=Toner layer potential after development/Developing bias voltage Δv in a unit step FIG. 7 is a graph showing a relationship between relative humidity and potential ratio to full potential α. The potential ratio to full potential α greatly depends on change in the amount of toner charge. Because the amount of toner charge largely changes with relative humidity in environment as illustrated in FIG. 7, the potential ratio to full potential α should be changed to a value suitable for the relative humidity in the environment.

Specifically, if the relative humidity detected by the environmental sensor is relatively small, the potential ratio to full potential a should be set larger. If the relative humidity is relatively large, the potential ratio to full potential α should be changed to a smaller setting.

(d) Electrostatic Capacity of Photosensitive Medium Cm

Electrostatic capacity of a photosensitive medium Cm primarily changes with long-term use involving wear of the photosensitive layer over the surface of the photosensitive medium, deterioration of the material of the photosensitive layer, and change over time in a gap between the development roller and the surface of the photosensitive medium. Based on cumulative operation time, that is, cumulative values indicating how long the image forming apparatus has been used, such as the photosensitive medium rotation counter and print sheet counter, the electrostatic capacity of the photosensitive medium Cm is obtained from a predetermined arithmetic expression or reference table.

In particular, the above values of data about cumulative operation time are low, the electrostatic capacity of the photosensitive medium Cm should be set larger. If the values of data about cumulative operation time are high, the electrostatic capacity of the photosensitive medium Cm should be changed to a smaller setting.

(e) Transfer Efficiency T

Transfer efficiency T is ratio of the amount of charge for transfer given to a recording medium to the amount of charge possessed by the toner layer on the intermediate transfer belt. As the amount of charge for transfer given to the recording medium increases, static electricity that acts on the surface of the toner layer on the intermediate transfer belt becomes stronger than the mechanical adherence of the toner and transfer of the toner begins.

The transfer efficiency T may change, depending on relative humidity in environment and cumulative operation time of the apparatus. Based on relative humidity detected by the environmental sensor and the data about cumulative operation time, that is, data indicating how long the apparatus has been used, such as the photosensitive medium rotation counter and print sheet counter, the transfer efficiency T is obtained from a predetermined arithmetic expression or reference table. However, if the transfer efficiency T is controlled to be constant by image adjustment control, the transfer efficiency T may be set to a fixed value.

[(2) Calculating Toner Concentration Tc]

After calculating the amount of toner charge Q, toner concentration Tc is calculated.

Since a relationship between toner concentration Tc and the amount of toner charge Q is defined as in the following equation (2), the toner concentration Tc is calculated, using this equation.

$$Tc = \frac{(1-k)\times Q\times j2}{(1+k)\times Q\times j1} \tag{2}$$

where

Tc: Toner concentration k: Coefficient for calculating toner concentration

Q: Amount of toner charge j1: Coefficient j2: Coefficient

Coefficient j1 is obtained from the diameter of a toner particle, the diameter of a carrier granule, and toner consistency. Coefficient j2 is obtained from the diameter of a toner particle and toner consistency. From the carrier granule diameter and toner particle diameter/consistency measurements obtained beforehand, these coefficients can be determined.

Figure 8:
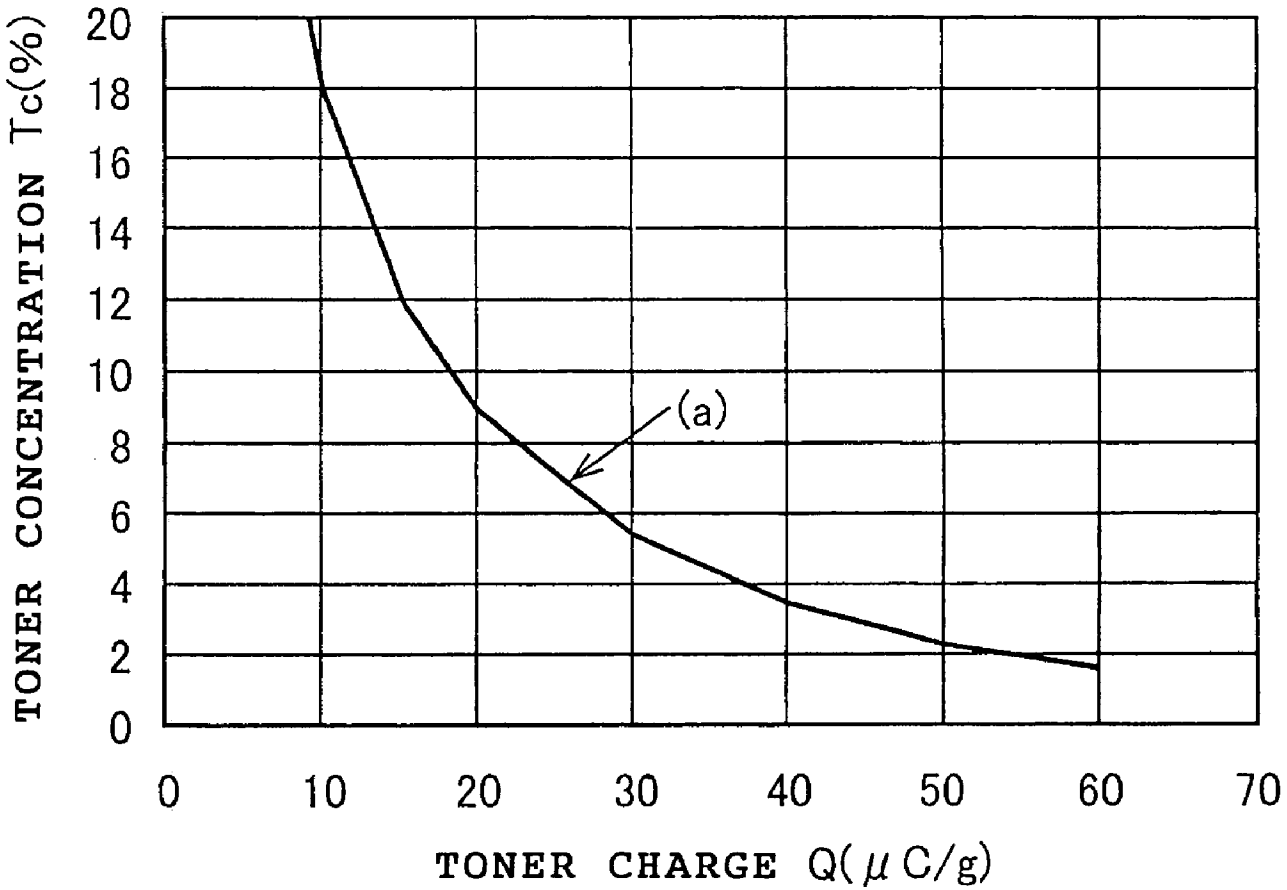
FIG. 8 is a diagram showing a correlation between amount of toner charge and toner concentration.
Figure 9:
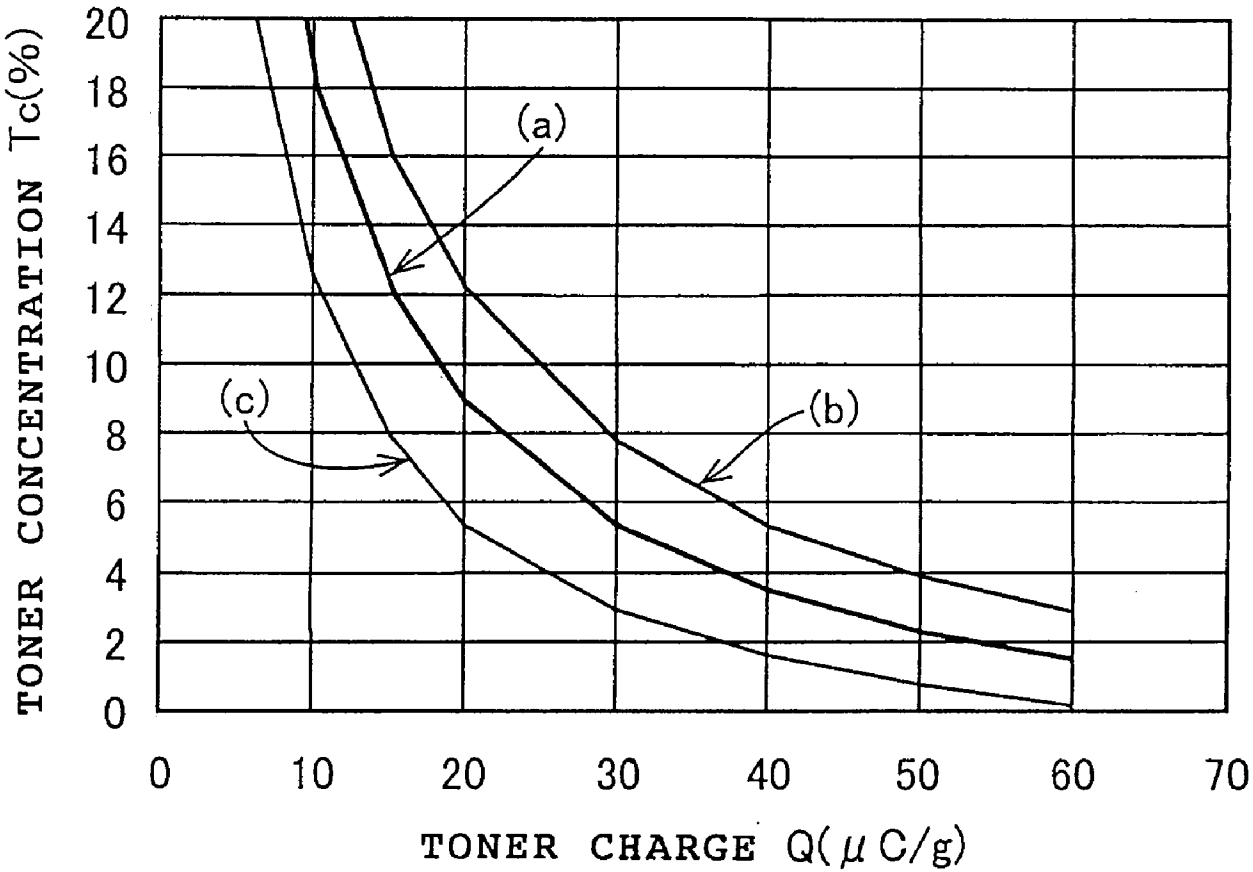
FIG. 9 is a diagram showing a correlation between amount of toner charge and toner concentration varying depending on environment (relative humidity)

Coefficient for calculating toner concentration k is explained. FIG. 8 is a diagram showing a relationship between the amount of toner charge Q (μC/g) and toner concentration Tc (%). FIG. 9 is a diagram showing a correlation between the amount of toner charge Q (μC/g) and toner concentration Tc (%) varying depending on relative humidity in environment.

There is the correlation between the amount of toner charge and toner concentration as indicated by a characteristic curve (see curve (a)) shown in FIG. 8 and this correlation characteristic varies with change in relative humidity in environment and developer deterioration because of its long-term use.

This is because the amount of toner charge changes as the relative humidity in environment changes and during the use of the developer for a period. As the humidity in environment changes, the correction characteristic indicated by curve (a) in FIG. 8 shifts as shown in FIG. 9. Specifically, in low-humidity environment, the amount of toner charge becomes higher and the characteristic curve representing the correlation between the amount of toner charge and toner concentration shifts upward (see curve (b) in FIG. 9). In high-humidity environment, the amount of toner charge becomes smaller, the characteristic curve shifts downward (see curve (c) in FIG. 9).

Figure 10:
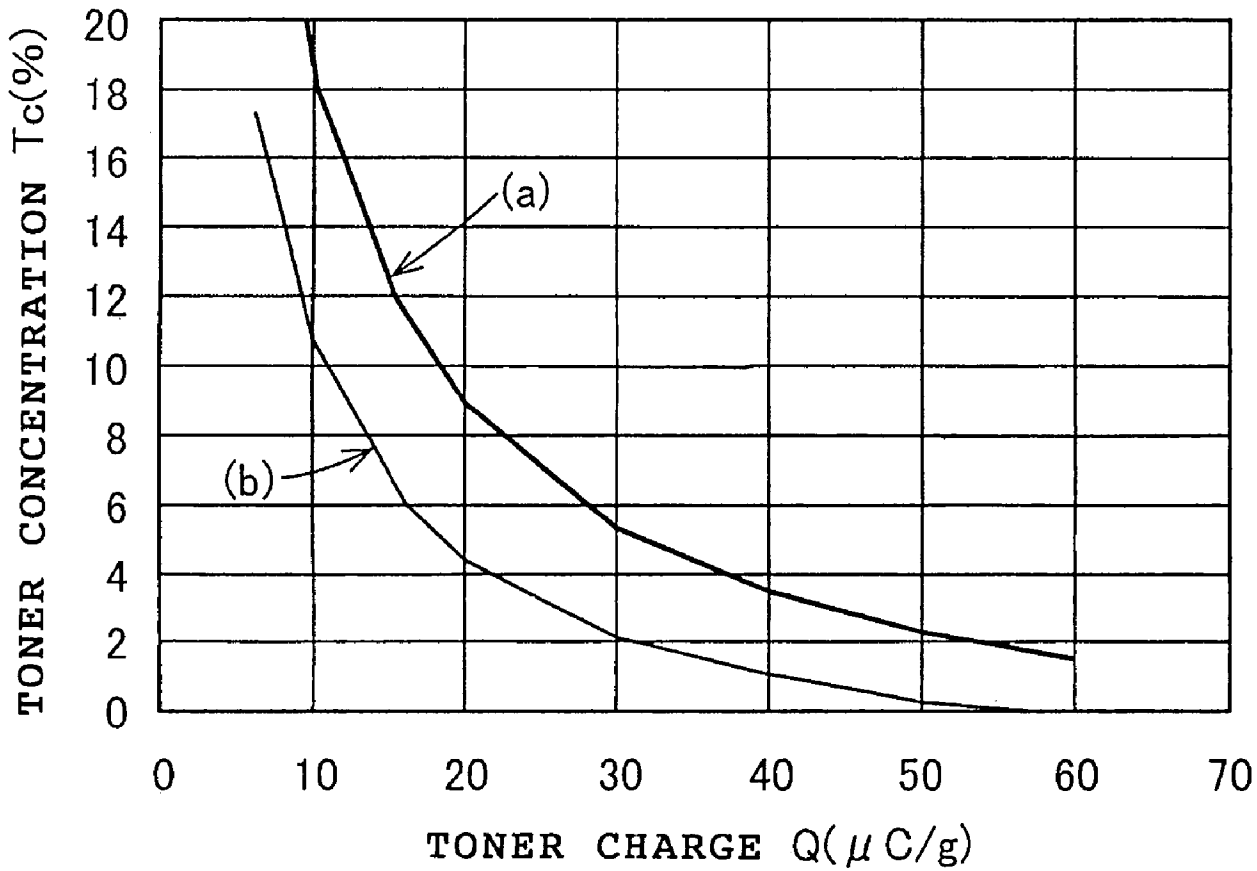
FIG. 10 is a diagram showing a relation between toner charge and toner concentration degraded by developer deterioration due to its long-term use.

FIG. 10 is a diagram showing a relation between the amount of toner charge and toner concentration degraded by developer deterioration due to its long-term use. As the amount of toner charge rises, the toner concentration falls, and the toner concentration also falls when the developer deteriorates during its long-term use. Specifically, as shown in FIG. 10, even at the same level of the amount of toner charge, the toner concentration in a new developer is high and shows a good characteristic curve (see curve (a) in FIG. 10), whereas the toner concentration in a developer that has been used long (after its long-term use) becomes lower and its characteristic curve shifts downward (see curve (b) in FIG. 10).

As described above, the characteristic between the amount of toner charge and toner concentration varies with change in the relative humidity in environment and developer deterioration due to its long-term use. Accordingly, if the toner concentration is calculated from the above equation (2) without taking these factors of variation into account, the calculated toner concentration would differ from actual toner concentration in the developers provided in the developing units.

The coefficient for calculating toner concentration k is used to compensate this difference. This coefficient can be obtained from environmental relative humidity data detected by the environmental sensor and the cumulative use period data of the apparatus such as the photosensitive medium rotation counter, printed sheets counter, and toner consumption data (which can be obtained from a counter that counts the number of times of toner supply) by referring to a table or by a calculation formula.

Figure 11:
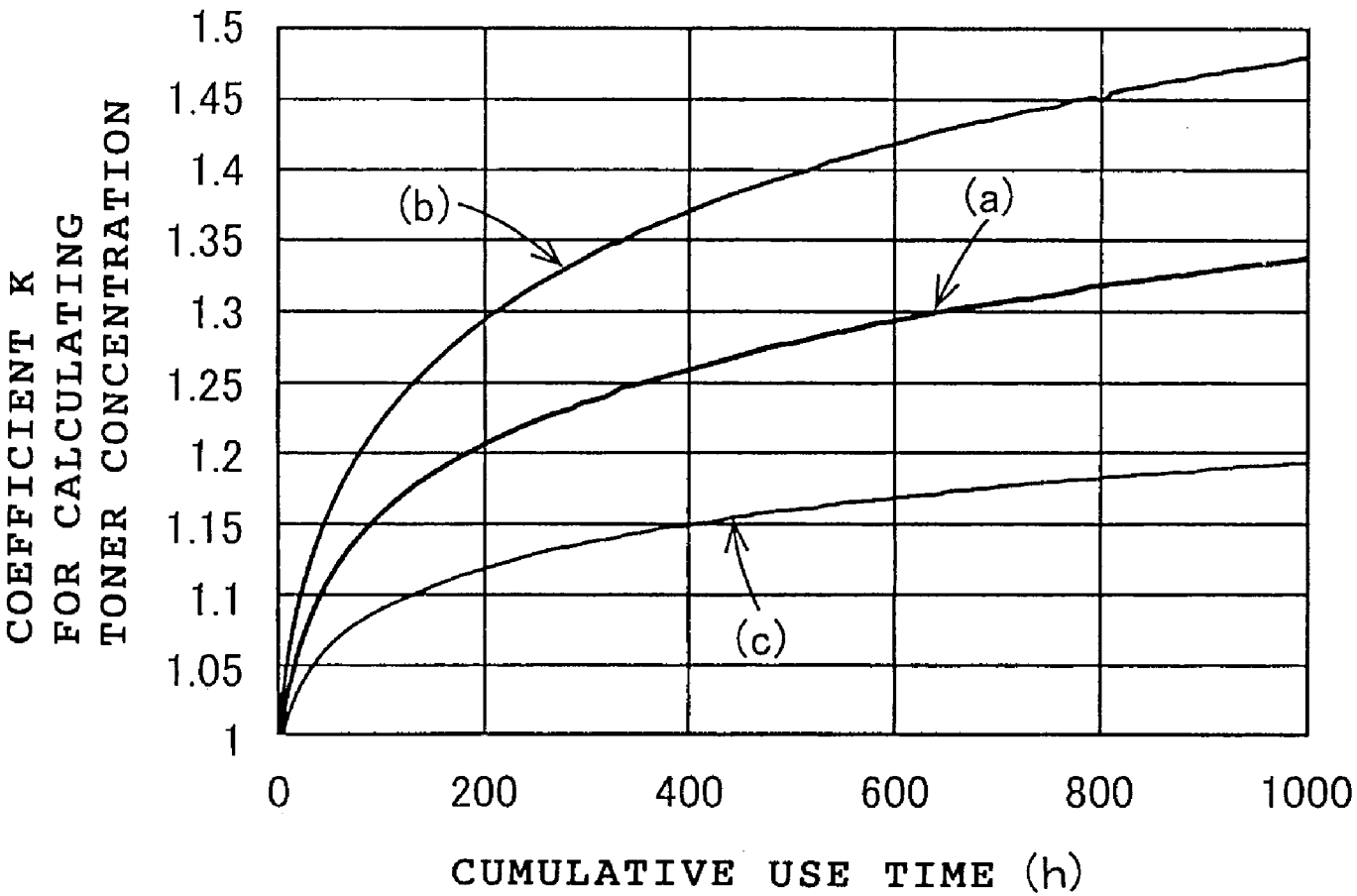
FIG. 11 is a diagram showing a relationship between a duration counter value of cumulative use time which indicates how long the developer has been used after it is put in use as a new one and a coefficient k for calculating toner concentration.

FIG. 11 is a diagram showing a relationship between a cumulative use time counter of the equipment which indicates how long the developer has been used after it is put in use as a new one and the coefficient k for calculating toner concentration. In standard humidity environment, the relationship characteristic changes as indicated by curve (a) in FIG. 11. The relationship characteristic changes as indicated by curve (b) in FIG. 11 in low-humidity environment and changes as indicated by curve (c) in FIG. 11 in high-humidity environment. Therefore, when the cumulative use period data and the environmental relative humidity data detected by the environmental sensor (standard, low, or high humidity) are obtained, the coefficient for calculating toner concentration k can be determined from the characteristic curve shown in FIG. 11.

Now, when the amount of toner charge Q has been calculated by the above equation (1) and the coefficient k for calculating toner concentration has been determined, the toner concentration Tc can be calculated by the above equation (2).

While development efficiency is obtained from the plurality of toner patches and toner concentration is calculated, the toner patches can also be used for the adjustment of maximum image density.

Figure 12:
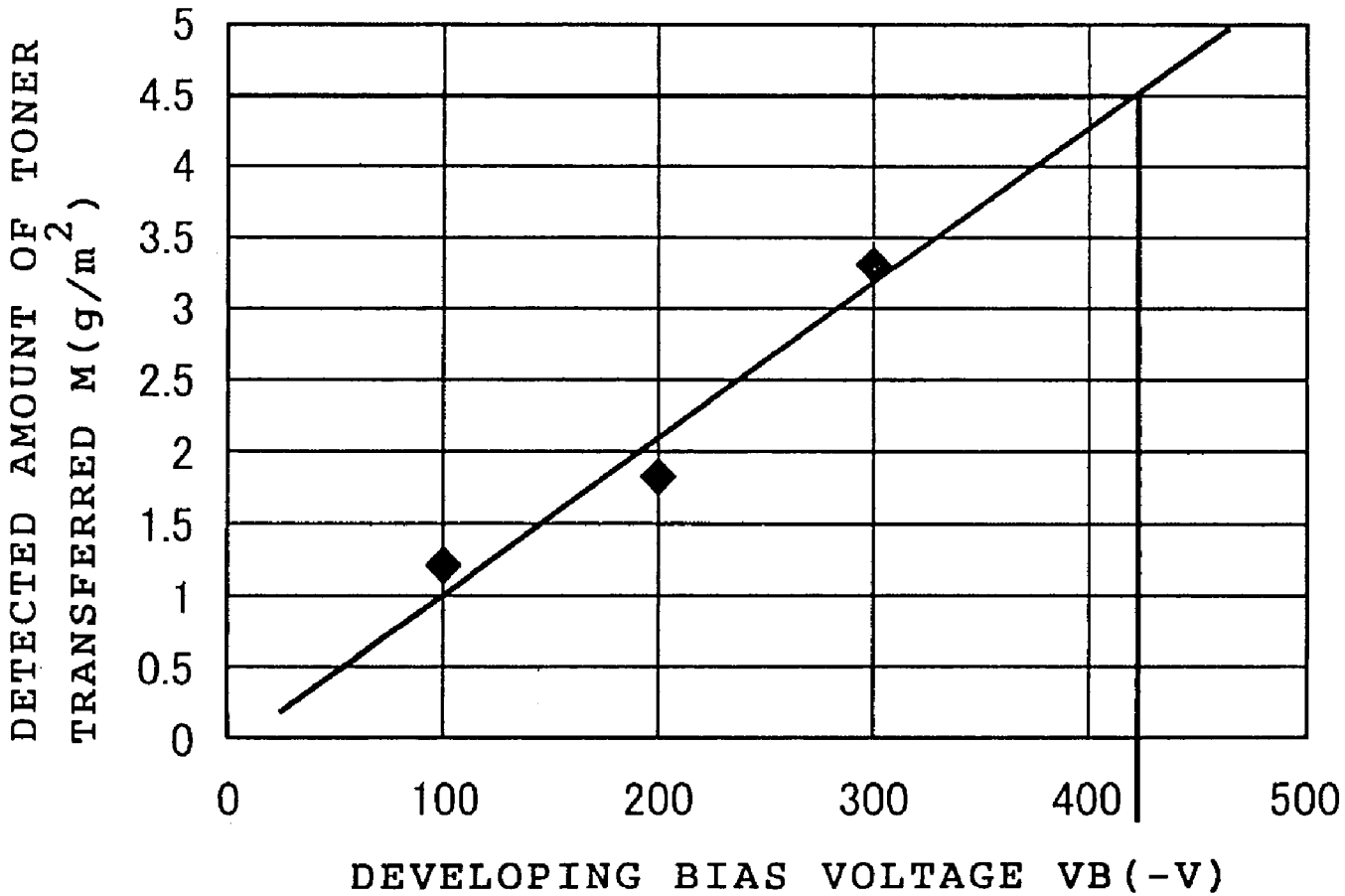
FIG. 12 is a graph that is used for obtaining an amount of toner transferred M from a developing bias voltage VB.

FIG. 12 is a diagram used for obtaining an amount of toner transferred M from a developing bias voltage VB. In particular, after detecting amounts of toner transferred M, while changing the developing bias voltage VB, a functional equation is created from the detected values. Because the development characteristics of the developing units in this embodiment can be approximated to linearity, a linear functional equation is created.

From the created linear functional equation, a developing bias voltage VB at which the target maximum amount of toner transferred is obtained is determined (in the example shown in FIG. 12, maximum amount of toner transferred Mmax=4.5 g/m2, developing bias voltage VB=−425 V), and this value is set as a developing bias voltage after image density adjustment.

By thus using the toner patches for detecting the amounts of toner transferred as those for maximum density adjustment as well, it is possible to shorten time required for image adjustment and reduce toner consumption during image adjustment.

[(3) Counting Pixels of Image Data and Predicting Toner Consumption]

Counting pixels of image data and predicting toner consumption are explained. In order to predict toner consumption, the number of effective pixels (to which toner is to be transferred) to make up an image for one line in a main scan direction is counted and this count is multiplied by the number of lines per page, thus calculating the number of effective pixels per page. By multiplying this number by the amount of toner transferred per pixel, the toner consumption is predicted.

Figure 13:
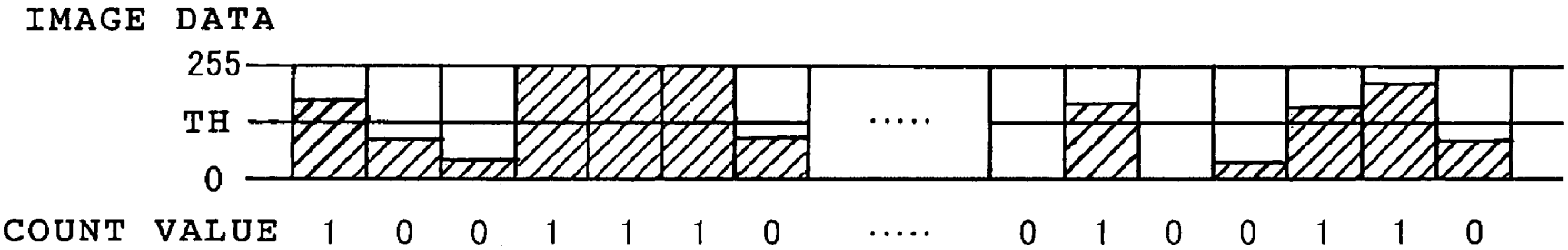
FIG. 13 is a diagram to explain counting only effective pixels by comparing image data stored in each pixel to a count decision threshold for the pixels on one line in a main scan direction.
Figure 15:
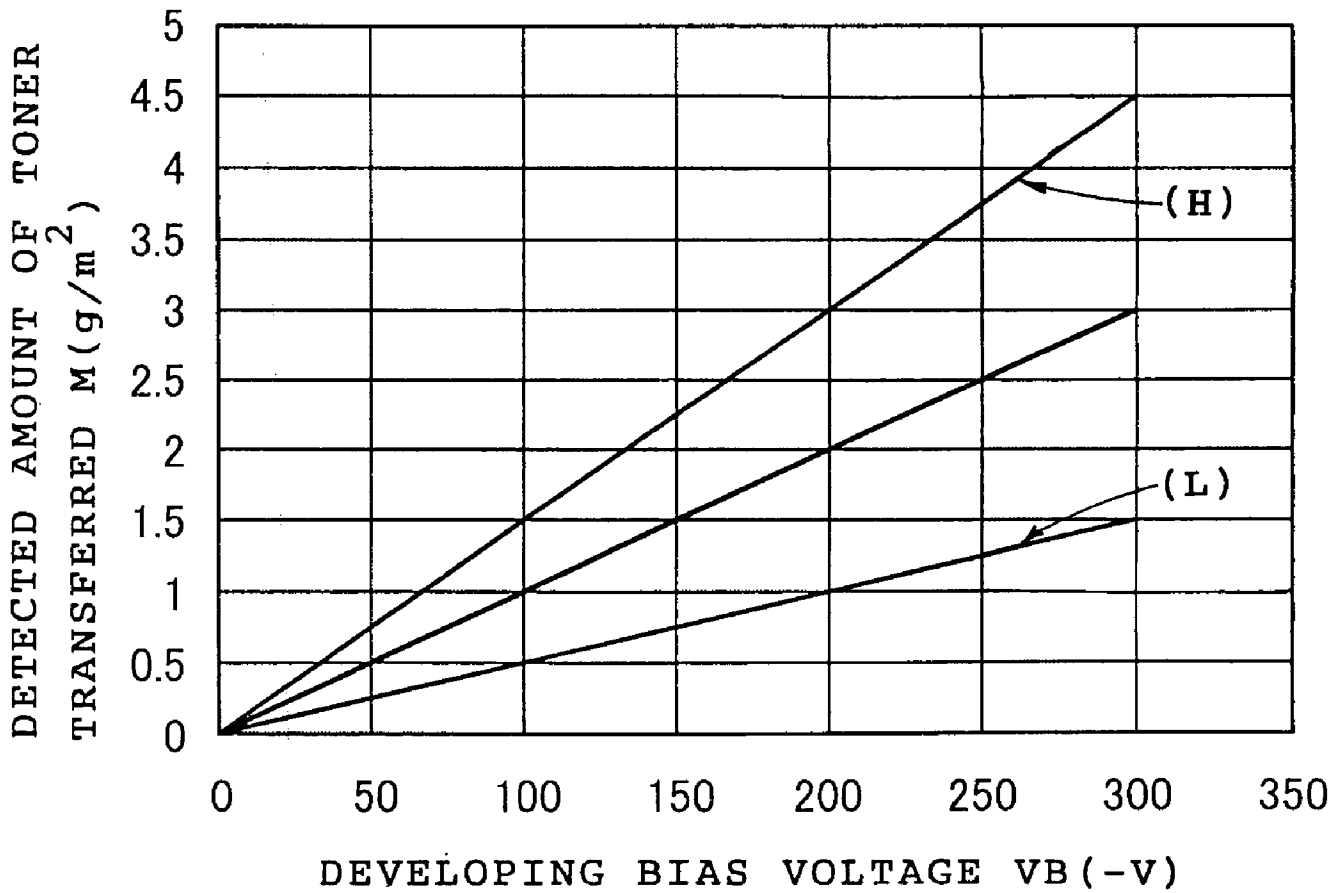
FIG. 15 is a diagram showing a relationship between developing bias voltages and amounts of toner transferred for different levels of toner concentration (case 1)
Figure 16:
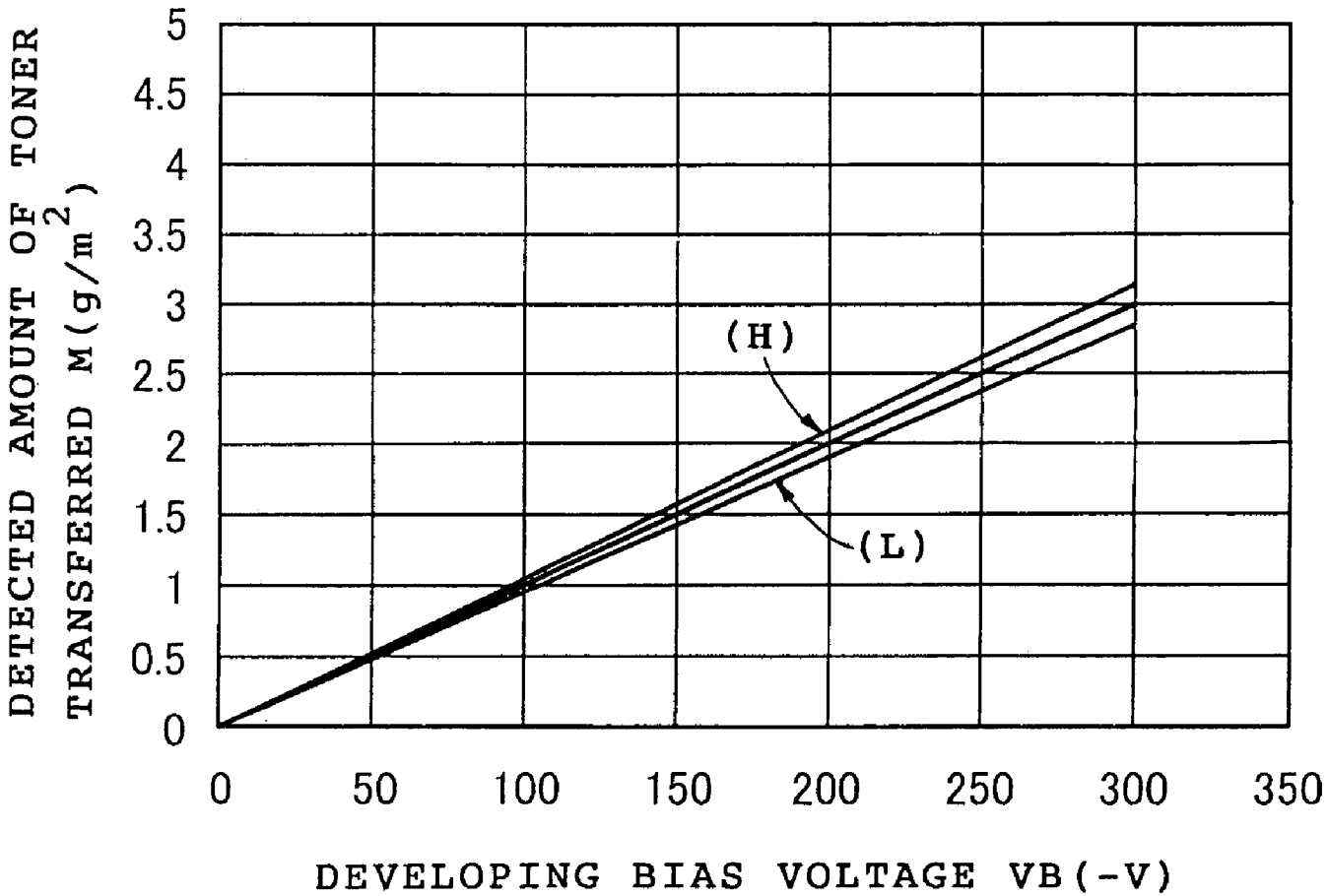
FIG. 16 is a diagram showing a relationship between developing bias voltages and amounts of toner transferred for different levels of toner concentration (case 2).

FIG. 13 is a diagram to explain counting only the effective pixels to which toner is to be transferred by comparing image data stored in each pixel to a count decision threshold for the pixels on one line in the main scan direction. In this embodiment, image data (up to 8 bits, 0 to 255) stored in each pixel is compared to the count decision threshold TH and the pixels containing sufficient image data are counted, according to the following decision rule:

Decision rule

If Ddot≧TH, Dc-dot=1

If Ddot<TH, Dc-dot=0

Ddot: Image data stored in each pixel (up to 8 bits, 0 to 255)

TH: Count decision threshold

Dc-dot: Pixel containing image data

Here, when pixel containing image data Dc-dot=1, a pixel is the one to which toner is to be transferred (effective pixel) and one count occurs. When the count Dc-dot=0, a pixel is the one to which toner is not to be transferred (ineffective pixel) and no count.

The above decision is performed for all pixels and the count Dc-dot values are added up, for example, an integration value Dc-page of the count Dc-dot values per page is calculated and stored into a storage device.

Then, from the calculated integration value Dc-page of the count values, for example, predicted toner consumption CONS-page per page is calculated. For this calculating, use the following equation (3):

$$\text{CONS-page}=(\text{Dc-page})\times(\text{Mtg-dot}) \quad (3)$$

where

CONS-page: Predicted toner consumption per page

Dc-page: Integration count of pixels containing image data per page

Mtg-page: Target amount of toner transferred per pixel

Predicted toner consumption per page obtained in this manner is output to a toner supply amount calculation section.

In the arrangement of the above-described embodiment of the invention, each pixel is assigned a binary value 0 or 1 by comparing the size of its image data to the count decision threshold TH and the pixels with a value of 1 per page are counted. In an alternative arrangement, the bits of multi-valued image data of each pixel may be directly counted without assigning a binary value to each pixel. Bits of pixel data may be counted not only to determine image data size per page, but also for an edge decision counter or the like, and predicted toner consumption may be calculated.

Next, a method of determining the amount of toner supply from the predicted toner consumption CONS-page thus calculated is explained. FIG. 14 is an example of a numerical table that is used to determine the amount of toner supply from the calculated toner concentration Tc and predicted toner consumption and this table should be created beforehand from experimental data.

The values given in the table correspond to the speed (number of rotations) of a toner hopper motor. For example, given that the calculated toner concentration Tc is 5.5% and predicted toner consumption CONS-page is 240 mg, the speed (number of rotations) of the toner hopper motor should be set at 260.

The above-described toner supply control is performed by the CPU of the control unit that constitutes the control circuit of the image forming apparatus, but this control unit is not shown.

As fully described hereinbefore, according to the method and device for estimating toner concentration of this invention, the amount of toner charge is calculated, based on obtained information via the parameter of amount of toner transferred to the photosensitive medium and the parameters of toner layer ratio to full formation, developing bias voltage, potential ratio to full potential, electrostatic capacity of photosensitive medium, and transfer efficiency. The calculated amount of toner charge is compensated by compensation data that is determined, based on environmental relative humidity data and cumulative use period data of the image forming apparatus and toner concentration is estimated. Therefore, accurate toner concentration estimation can be performed even in a development system where the development efficiency does little change with change in toner concentration.

Since the invented image forming apparatus eliminates the need for installing toner concentration sensors each in all developing units, which is, however, required for prior-art apparatus for image forming, the cost of manufacturing of the apparatus can be reduced.

The image forming apparatus of this invention estimates toner concentration by the above method for estimating toner concentration and predicts toner consumption from the estimated toner concentration. This apparatus further includes a toner consumption predicting section which predicts toner consumption, based on the predicted toner consumption and estimated toner concentration, so that the developing units are supplied with toner, according to the predicted toner consumption.

Therefore, this apparatus provides the same advantageous effect as obtained by the method for estimating toner concentration. Moreover, the apparatus is able to automatically supply toner to the developing units if the estimated toner concentration becomes less than a predetermined range of concentration. Consequently, the apparatus is able to produce high-quality image prints, keeping image density within a predetermined range.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A method for estimating toner concentration in a two-component developer consisting of toner and carrier, wherein said method is suitable for an electrophotographic image forming apparatus, said method comprising the following steps:

a first step of calculating an amount of toner charge, based on information via parameters comprising amounts of toner transferred onto test toner patches formed on a photosensitive medium, toner layer ratio to full formation, developing bias voltage, potential ratio to full potential, electrostatic capacity of a photosensitive medium, and transfer efficiency; and a second step of compensating the calculated amount of toner charge by compensation data that is determined, based on environmental relative humidity data and cumulative use period data of the image forming apparatus, and estimating toner concentration.

2. A device for estimating toner concentration in a two-component developer consisting of toner and carrier, wherein said device is suitable for use in an electrophotographic image forming apparatus, said device comprising:

a transferred toner amount sensor which detects amounts of toner transferred onto test toner patches formed on a photosensitive medium;

an environmental humidity sensor which detects relative humidity in the environment where the image forming apparatus is placed;

counting instrumentation which counts data corresponding to a cumulative use period of the image forming apparatus; and a control unit wherein said control unit obtains parameters of:

amount of toner transferred detected by said transferred toner amount sensor, toner layer ratio to full formation, developing bias voltage, potential ratio to full potential, electrostatic capacity of photosensitive medium, transfer efficiency based on the toner amount transferred, environment humidity detected by said environmental humidity sensor, and cumulative use period data of image forming apparatus counted by said counting instrumentation, and wherein said control unit estimates toner concentration by performing the following steps:

a first step of calculating an amount of toner charge, based on information via the parameters comprising the amounts of toner transferred to test toner patches formed on a photosensitive medium, toner layer ratio to full formation, developing bias voltage, potential ratio to full potential, electrostatic capacity of a photosensitive medium, and transfer efficiency; and a second step of compensating the calculated amount of toner charge by compensation data that is determined, based on the environmental relative humidity data and the cumulative use period data of the image forming apparatus, and estimating toner concentration.

3. The device for estimating toner concentration according to claim 2, further comprising a toner consumption predicting unit which predicts toner consumption, based on the number of pixels to make up a toner image formed on said photosensitive medium.

4. The device for estimating toner concentration according to claim 2, wherein said counting instrumentation which counts data corresponding to a cumulative use period of the image forming apparatus comprises any or all of a counter which counts the total number of rotations of photosensitive medium, a counter which counts the total number of sheets of recording medium on which an image has been formed, and a counting instrument which counts a numerical value indicating toner consumption.

5. An electrophotographic image forming apparatus using a two-component developer consisting of toner and carrier, comprising:

image forming units which develop a latent image formed on a photosensitive medium with the developer loaded in a developing unit and forms a toner image on the photosensitive medium;

transfer units which transfer the toner image formed on said photosensitive medium onto a recording medium;

a transferred toner amount sensor which detects amounts of toner transferred onto test toner patches formed on the photosensitive medium;

an environmental humidity sensor which detects relative humidity in environment where the image forming apparatus is placed;

counting instrumentation which counts data corresponding to a cumulative use period of the image forming apparatus;

a toner supply unit which supplies toner to the developing unit of each said image forming unit; and a control unit wherein said control unit performs a control process comprising:

(1) calculating an amount of toner charge based on amounts of toner transferred detected by said transferred toner amount sensor, toner layer ratio to full formation, developing bias voltage in unit steps, potential ratio to full potential, electrostatic capacity of a photosensitive medium, and transfer efficiency;

(2) compensating the calculated amount of toner charge by compensation data that is determined based on the environmental relative humidity data and the cumulative use period data of the image forming apparatus, and estimating toner concentration; and (3) determining an amount of toner supply, based on the estimated toner concentration, and activating the toner supply unit to supply the toner to said developing unit.

6. The image forming apparatus according to claim 5, wherein said counting instrumentation which counts data corresponding to a cumulative use period of the image forming apparatus is any or all of a counter which counts the total number of rotations of photosensitive medium, a counter which counts the total number of sheets of recording medium on which an image has been formed, and an counting instrument which counts a numerical value indicating toner consumption.

7. The image forming apparatus according to claim 5, further comprising a toner consumption predicting unit which predicts toner consumption, based on the number of pixels to make up a toner image formed on said photosensitive medium, wherein said control unit determines an amount of toner supply, based on the toner consumption predicted by said toner consumption predicting unit and said estimated toner concentration, and activates the toner supply unit to supply the toner to said developing unit.

8. The image forming apparatus according to claim 5, wherein said test toner patches are also used as toner patterns for maximum density adjustment of an image.

* * * * *